United States Patent [19]

Kaneko

[11] Patent Number: 4,810,215

[45] Date of Patent: Mar. 7, 1989

[54] POSITION COMPENSATING CONNECTOR

[75] Inventor: Tomohisa Kaneko, Kosai, Japan

[73] Assignee: Yazaki Corporation, Japan

[21] Appl. No.: 871,373

[22] Filed: Jun. 6, 1986

[30] Foreign Application Priority Data

Jun. 6, 1985 [JP] Japan ..... 60-121450
Jun. 6, 1985 [JP] Japan ..... 60-084537[U]

[51] Int. Cl.[4] ..... H01R 23/72; H01R 13/11

[52] U.S. Cl. ..... 439/845; 439/849; 439/865; 29/842; 29/845

[58] Field of Search ..... 29/830, 842, 845; 439/76, 845, 849, 850, 865–867

[56] References Cited

U.S. PATENT DOCUMENTS 4,418,475 12/1983 Ammon et al. ..... 29/842

FOREIGN PATENT DOCUMENTS 608591 3/1985 Japan .

*Primary Examiner*—Timothy V. Eley
*Assistant Examiner*—Taylor J. Ross
*Attorney, Agent, or Firm*—Wigman & Cohen

[57] ABSTRACT

A connector has a connector terminal that has a connecting section for a partner terminal on one end of a conducting plate, a board insertion section on the other end, and a curved section for absorbing the deviations in the vertical. The connector also has horizontal directions in the middle of the conducting plate, and a housing which houses the connector terminal which has a board mounting plate on the side of the base end, and the board mounting plate mounted so as to be horizontally movably on the board via a fixing stand of the board insertion section.

9 Claims, 6 Drawing Sheets

POSITION COMPENSATING CONNECTOR

BACKGROUND OF THE INVENTION

1. Field of the Invention

The present invention relates to a connector that connects printed boards or a printed board to an external connector.

2. Description of Prior Art

In the past, as a connector for connecting printed boards there has been proposed one as shown in FIG. 1. The connector is composed of a connector terminal T and a housing H. The connector terminal links a pin supporting section b that has a pin insertion hole a and a board insertion section c with a movable plate d. The housing H has foot sections e which are hooked freely movably in the lateral direction to hooking slits g in a printed board f.

When the terminal T is fitted to the housing H and the printed board f is inserted to the board insertion section c to connect the printed boards, the deviation of the terminal T in the lateral direction x is absorbed by the movable plate d, and the deviation in the longitudinal direction y that accompanies the insertion of a pin P is absorbed by the pin insertion hole a.

However, if the pin P is to be inserted in the state as shown in FIG. 2, stresses concentrate on one of the pin contacting pieces b' to generate a deformation as shown in FIG. 3, giving rise to a possibility of reducing the reliability in electrical connection. In addition, to absorb the errors in the inserted position of the pin P, it becomes necessary to secure a space greater than xy which results in the problem of making the size of the terminal and the housing large.

SUMMARY OF THE INVENTION

An object of the present invention is to provide a connector which is capable of solving the above problems and making its size small.

Another object of the present invention is to provide a connector which reduces the possibility of easy deformation in the connector terminal that makes a contact with a partner terminal.

Another object of the present invention is to provide a connector which includes a connector terminal that has reduces the possibility of a deterioration of the reliability of electrical connection.

Another object of the present invention is to provide a connector whose manufacturing process can be simplified due to its simple construction.

Another object of the present invention is to provide a connector which permits a secure connection with a partner terminal.

Another object of the present invention is to provide a connector terminal which permits a secure connection with partner terminal.

Another object of the present invention is to provide a method for mounting a connector on the board in which, even when a lateral positional deviation in connecting the boards via the connector is generated, the positional deviation can be absorbed readily by changing the lateral mounting position of the connector with respect to the board.

In a connector which comprises a connector terminal and a housing which houses the connector terminal, a feature of the present invention which is aimed at solving the above-mentioned problems is that the connector terminal has a connecting section for a partner terminal on one end in the longitudinal direction of the conducting plate, a board insertion section on the other end, and a first and a second flexible sections, that can be bent in a first and a second directions that are mutually perpendicular and are respectively perpendicular to the direction of insertion of the connector, in the middle, and the housing has a board mounting plate on the side of base end, whereby the lateral positional deviation that may arise between the partner terminal and the connector terminal can be absorbed readily by the first and second flexible sections of the connector terminal.

Another feature of the present invention is, in a connector terminal comprising a conducting plate, that the connector terminal has a connecting section on one end in the longitudinal direction of the conducting plate, a board insertion section on the other end, and a first flexible section and a second flexible section that can be bent in a first and a second directions, respectively, that are mutually perpendicular and are respectively perpendicular to the direction of insertion of the connector, whereby the deviation in position in the lateral direction between the partner terminal can be absorbed easily.

Another feature of the present invention is, in the mounting method, to the board, of a connector consisting of a connector terminal and a housing which houses the connector terminal, that the present method has a board mounting plate in the housing, and the board mounting plate is mounted so as to be movable relative to the board in two directions that are mutually perpendicular and are respectively perpendicular to the direction of insertion of the connector, whereby the positional deviation in the lateral direction that may arise between the board that is connected via the connector may readily be absorbed.

These and other objects, features and advantages of the present invention will be more apparent from the following description of a preferred inventions, taken in conjunction with the accompanying drawings.

DESCRIPTION OF THE PREFERRED EMBODIMENT

Figure 1:
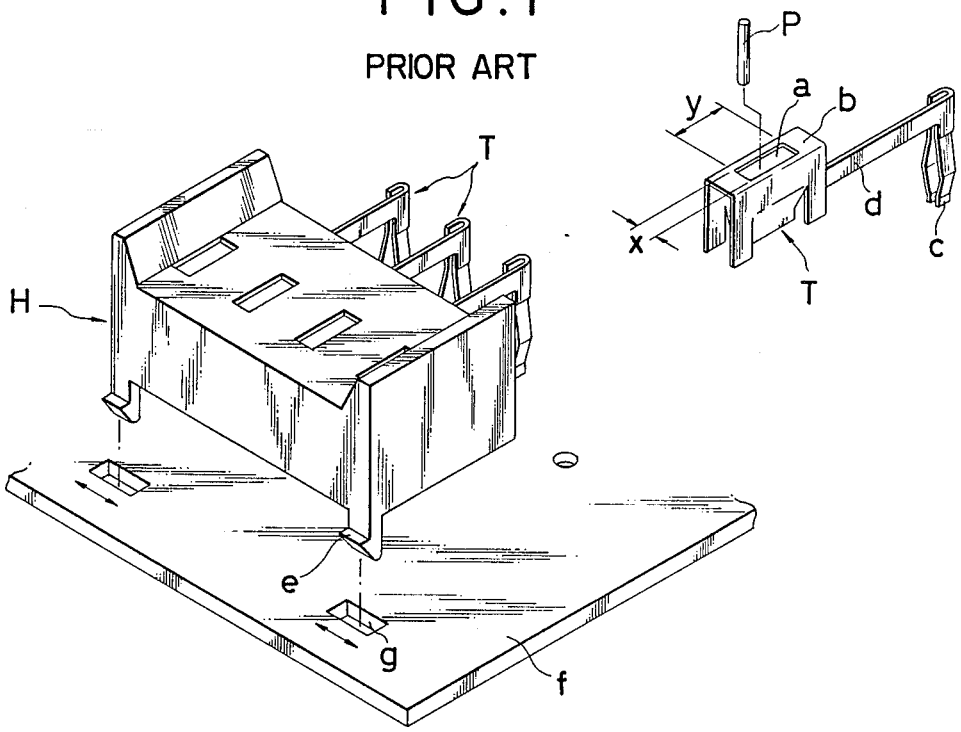
FIG. 1 PRIOR ART
FIGS. 1, 2, and 3 are explanatory diagrams for the construction and the operation of a prior art connector.
Figure 2:
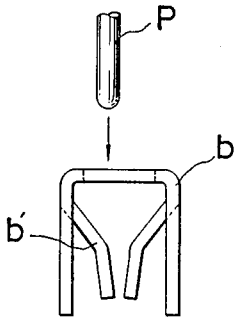
FIG. 2 PRIOR ART
Figure 3:
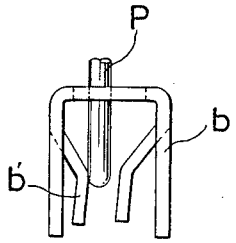
FIG. 3 PRIOR ART
Figure 4:
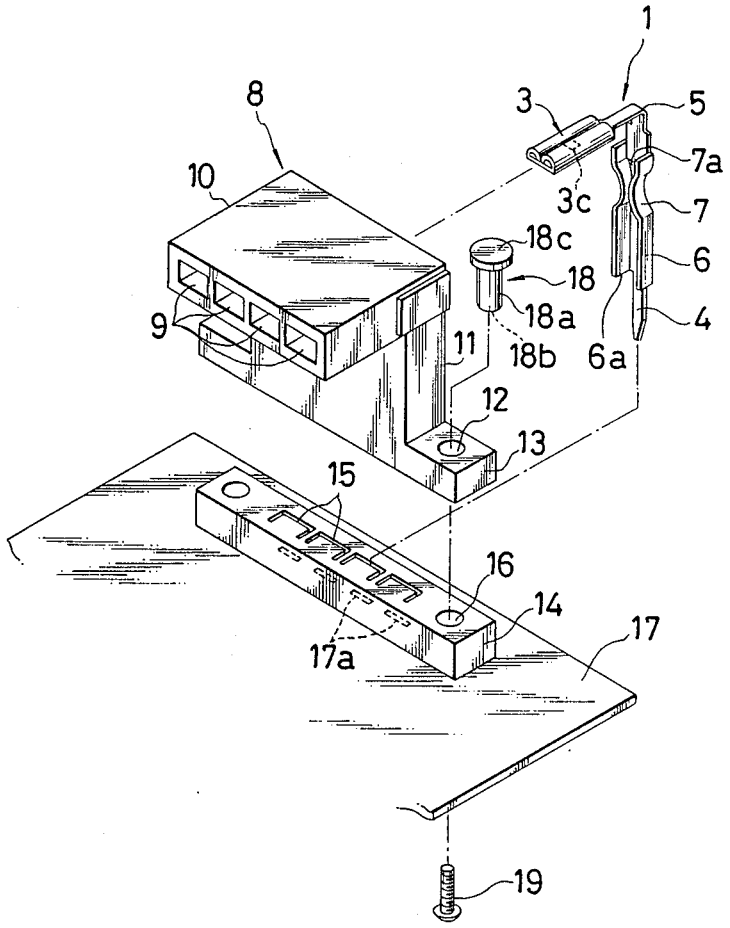
FIG. 4 is a disassembled explanatory diagram for an embodimment of the connector embodying the present invention.
Figure 5:
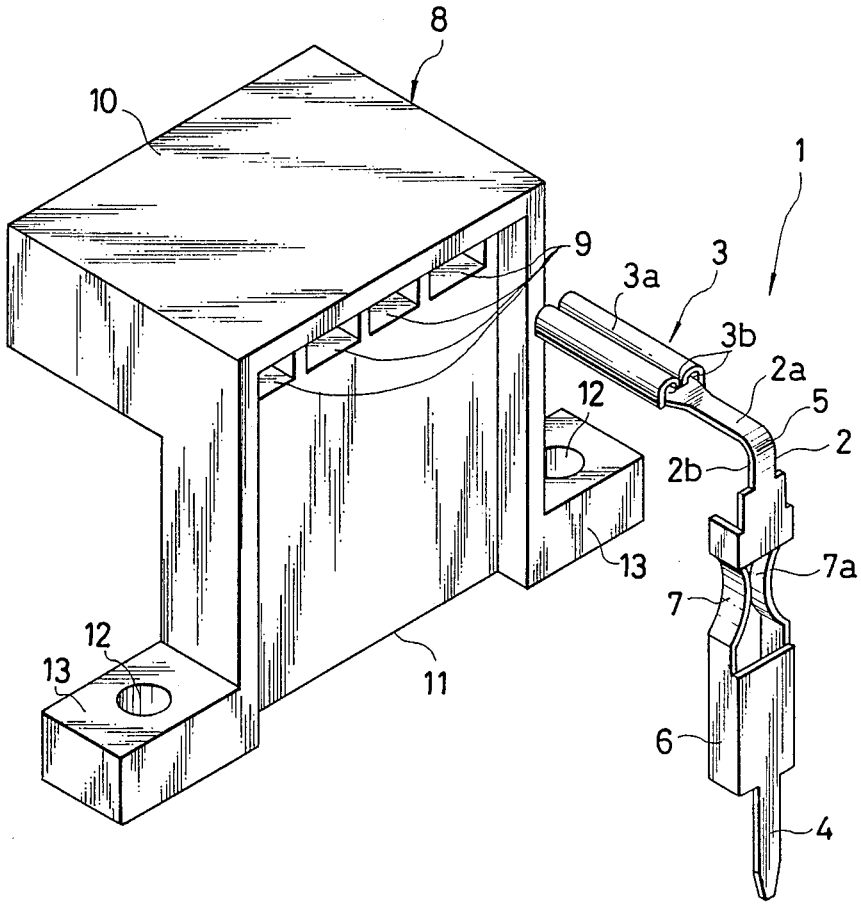
FIG. 5 is an enlarged explanatory diagram for the connector shown in FIG. 4 as seen from the rear.
Figure 6:
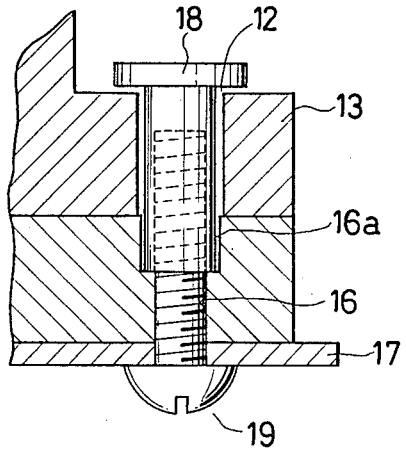
FIG. 6 is a partial sectional view for showing the mounted condition of the connector on the printed board.

Referring to FIGS. 4, 5 and 6 showing the connector of the present embodiment, there are provided an L-shaped connector terminal 1, a housing 8, a fixing stand 14 for the connector terminal, and a printed board 17.

The connector terminal 1 is formed by providing a connecting section 3 for a partner terminal on one end of a narrow band-like conducting plate 2 and a projecting board insertion section 4 for an insertion hole 17*a* of the printed board on the other end. The connector terminal 1 is also formed by bending the midsection of the conducting plate 2 to form an L shape. The bent portion between the horizontal part 2*a* and the vertical part 2*b* of the conducting plate 2 is curved in the form of an arc to form a curved section 5 for absorbing the deviation in the vertical position of the connector terminal 1. On the other hand, the vertical part 2*b* of the conducting plate 2 has reinforcing walls 6 on its both sides to form a U-shaped structure, and in addition, near its top end it has curved sections 7 of narrow width with a relief hole in between. The curved sections 7 are for absorbing the deviation in the horizontal direction of the top of the connector terminal 1. The connecting section 3 is formed as a female terminal that consists of erected side walls 3*a* on both sides of the horizontal part 2*a* and elastic pinching arms 3*b* that are formed by curling the free ends of the horizontal part 2*a* toward the inside. On the bottom surface of the connecting section 3 there is formed a hooking hole 3*c*.

In the above, the connecting section 3 may be formed as a tube-like male terminal instead of female terminal.

The housing 8 comprises a housing section 10 that has a plurality of housing rooms 9 that house the connecting sections 3 of the connector terminals 1 and a supporting wall section 11 (see FIG. 5) with its back side open for supporting the vertical part 2*b* of the terminal 1. In the base end section of the supporting wall section 11 there are provided, projected, board mounting plates 13 with circular through holes 12.

The fixing stand 14 (see FIG. 4) for holding the connector terminals with a predetermined separation has a plurality of positioning holes 15 for inserting the board insertion sections 4 and the parts 6*a* of the reinforcing walls 6 of the terminals 1. On both ends of the fixing stand 14 there are provided mounting holes 16 for the printed board 17. As shown in FIG. 6, the mounting hole 16 is formed as a stepped hole that has an increased diameter section 16*a* in its upper half portion. The through hole 12 of the board mounting plates 13 is given a margin in the diameter so that it has a diameter greater than that of the increased diameter section 16*a*. A fixture 18 is inserted in the through hole 12 and the mounting hole 16. As shown in FIG. 4, the fixture 18 is obtained by providing a brim 18*c* on a cylindrical main body 18*a* in whose interior is formed a screw hole 18*b*.

Next, referring to the FIG. 4, 5, 6, and 7 the action of the connector terminal and the setup of the connector will be described.

After the board insertion section 4 and the part 6*a* of the reinforcing walls 6 of the connector terminal 1 are forced in, or molded by inserting, to the positioning hole 15 of the fixing stand 14, to hold the connector terminal 1 at a prescribed depth, the connecting section 3 is inserted into the housing room 9 of the housing 8. The connecting section 3 has a structure in which hooking is accomplished by engaging a hooking arm, which is not shown, the hooking hole 3*c* (see FIG. 4).

Figure 7:
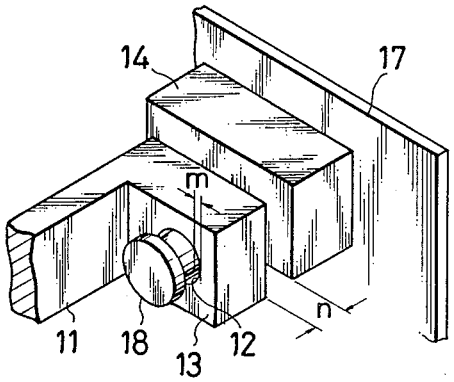
FIG. 7 is a partial perspective view of the mounting section shown in FIG. 6.

Next, the board mounting plate 13 of the housing 8, the fixing stand 14, and the printed board 17 are put one upon another as in FIG. 4, and are fixed with the fixture 18 and a screw 19. In doing so, the body 18*a* of the fixture 18 reaches as far as the increased diameter section 16*a* of the mounting hole 16 so that the fixing stand 14 and the printed board 17 can be fixed in a state which do not move relatively. However, the board mounting plate 13 is allowed to move slightly for a distance of m laterally and for a distance of n vertically (or in the front and back direction) by the through hole 12, as shown in FIG. 7. Next, the board insertion section 4 of the connector terminal 1, which projects out from the bottom surface of the insertion hole 17*a* (FIG. 4) of the printed board 17, is welded to the board circuit on the board 17 (not shown) to be electrically connected. In this way, setup for the connector terminal 1 and the printed board 17 can be accomplished.

Next, referring to the FIG. 8, 9 and 10, the connection between a printed board 17 to another printed board will be described.

Figure 8:
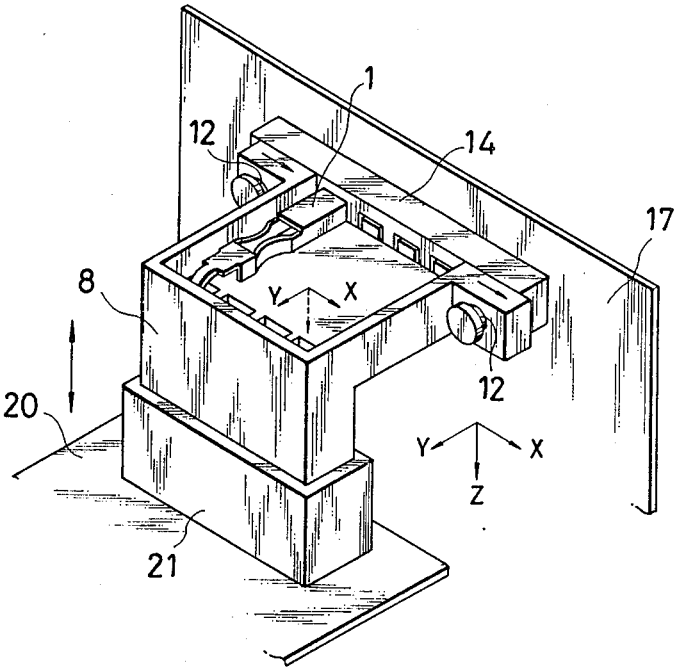
FIG. 8 is a perspective view for showing the connected condition of the connector shown in FIG. 4 on another printed board.

As shown in FIG. 8, the housing 8 will be fitted to a female housing 21 of a board 20. The female housing 21 has, in its interior, projected male terminals 22 corresponding to the connecting section. The female housing 21 also has surrounding walls 21*a*. A tapered surface 23 is provided at the upper inner edge of its surrounding walls 21*a*, as shown in FIG. 9.

Figure 9:
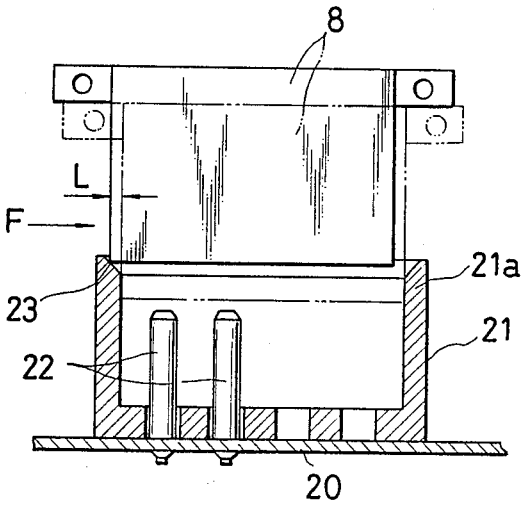
FIG. 9 is a sectional view for illustrating the principal action of the connector in the connected condition of the board shown in FIG. 8.
Figure 10:
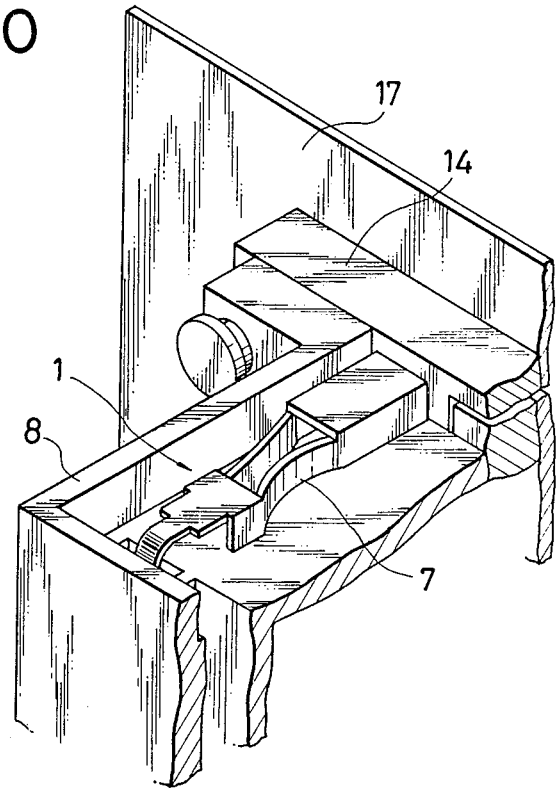
FIG. 10 is a perspective view of the main part of the connector shown in FIG. 8.

When a slight slippage L exists between the housing 8 and the female housing 21, the tip of the housing 8 makes a direct contact with the tapered surfaces 23 as shown in FIG. 9. However, under the lateral force F, the housing 8 is shifted sideways with respect to the printed board 17 due to the through hole 12. Along with the shift of the housing 8, there will be applied a force to the connecting section 3 of the connector terminal 1 from the inner wall of the housing room 9. This pressing force is absorbed by the curved section 7 as shown in FIG. 10. Consequently, the connecting section 3 alone is shifted, without relative shifting of the printed boards 17 and 20. These motions of the housing 8 and the connecting section 3 continue until a matched condition as represented by the doubly dotted chain line as shown in FIG. 9 is reached. The fitting will be accomplished in the state in which there is no slippage in the positions of the connecting section 3 and the male terminal 22.

On the other hand, the slippage in the vertical positions due to the connection depth between the connecting section 3 and the male terminal 22 can be absorbed by the expansion or contraction or the bending of the curved section 5 of the terminal 1.

As in the above, the error in positioning of the connector terminal 1 can be absorbed by the bending of the curved sections 5 and 7, without affecting the connecting section 3. Therefore, a stable condition of electrical connection can be achieved without fear of deforming the connecting section 3. Further, the error in positioning between the printed boards 17 and 20 can be absorbed by the shift of the housing 8.

Figure 11:
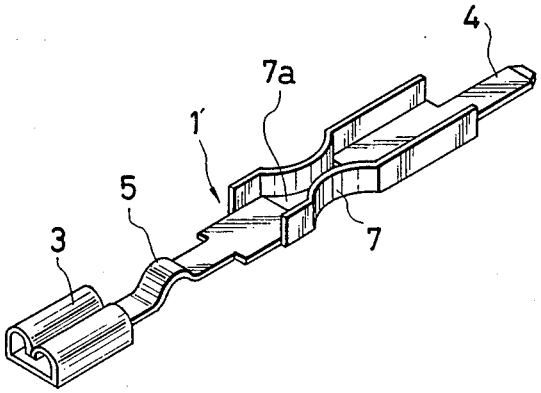
FIG. 11 and 12 are perspective views that show other embodiments of the connector terminal embodying the present invention.
Figure 12:
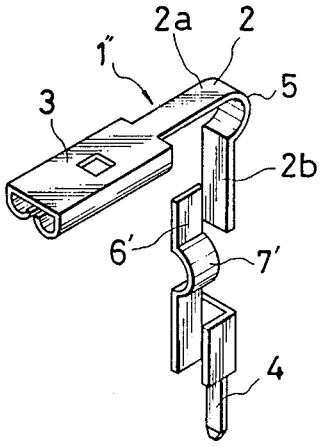

FIGS. 11 and 12 show additional embodiments of the connecting terminal. The connector 1' shown in FIG. 11 is the type in which the connecting section 3 and the board insertion section 4 of the terminal 1 are not bent. In this case, it becomes possible to connect two printed boards on a same plane, differing from the case shown in FIG. 8. The connecting terminal 1'' shown in FIG. 12 is the type in which the connecting section 3 is formed on the bottom side of the horizontal part 2a of the connecting terminal 2. At the same time, in the vertical part 2b, in place of the reinforcing walls 6, there is provided a single-sided wall 6', giving to the single-sided wall 6' a curved section 7' which is analogous to the curved section 7. In this case, it becomes possible to form the curved section 7' of an arbitrary size without subjecting it to the restrictions on the dimensions that are required in forming the curved section 7 in the reinforcing walls 6. Accordingly, it becomes possible to increase the absorbing power for the positional deviation in the lateral direction to reduce its influence on the connecting section 3, and to facilitate the manufacture of the connecting terminal 1.

In the connector of the present invention, the connecting section and the board insertion section of the connecting terminal are joined through two curved sections for absorbing the deviation in position in the vertical and the horizontal directions. Therefore, there is little fear of giving deformations of the connecting section due to external forces, making it possible to secure a stable electrical convention and to facilitate the miniaturization of the device. In addition, the connecting section may be given either female or male structure so that it has an advantage that it can be used for connecting the existing connector or the like as it is. Moreover, the housing for housing the connector terminal is mounted movably with respect to the printed board or the like so that it is possible to eliminate the error in positioning without affecting the board.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A connector comprising:

(i) a connector terminal having;

a connecting section formed on one end of the terminal for connecting the terminal with a partner terminal, a board insertion section formed on the other end of the terminal, a first and a second bendable section that are bendable in first and second directions, respectively, that are mutually perpendicular and are respectively perpendicular to the connecting direction of said partner terminal, between both ends of said terminal, (ii) a housing having a housing section and a base end section, said housing section having means for receiving said connector terminal, said housing further having;

a board mounting plate provided on the base end side of said housing.

2. The connector as claimed in claim 1, in which said connector terminal is formed by bending a strip-like structure in the form of the letter L and said first bendable section comprises the L-shaped bent section.

3. The connector as claimed in claim 1, in which said connector terminal is a monolithic elastic piece.

4. A connector comprising:

(i) a connector terminal having;

a connecting section formed on one end of the terminal for connecting the terminal with a partner terminal, a board insertion section formed on the other end of the terminal, a first and a second bendable section that are bendable in first and second directions, respectively, that are mutually perpendicular and are respectively perpendicular to the connecting direction of said partner terminal, between both ends of said terminal, (ii) a housing having a housing section and a base end section, said housing section having means for receiving said connector terminal, said housing further having;

a board mounting plate provided on the base end side of said housing;

in which said connector terminal is formed by bending a strip-like structure in the form of the letter L with an arching section at the corner of the letter L, which projects from the exterior side of the letter L, and said first bendable section comprises said arching section.

5. A connector comprising:

(i) a connector terminal having;

a connecting section formed on one end of the terminal for connecting the terminal with a partner terminal, a board insertion section formed on the other end of the terminal, a first and a second bendable section that are bendable in first and second directions, respectively, that are mutually perpendicular and are respectively perpendicular to the connecting direction of said partner terminal, between both ends of said terminal, (ii) a housing having a housing section and a base end section, said housing section having means for receiving said connector terminal, said housing further having;

a board mounting plate provided on the base end side of said housing;

in which said connector terminal has a linear form and said first bendable section comprises an arching section in the conducting plate that is provided at the midsection of the linear form.

6. A connector comprising:

(i) a connector terminal having;

a connecting section formed on one end of the terminal for connecting the terminal with a partner terminal, a board insertion section formed on the other end of the terminal, a first and a second bendable section that are bendable in first and second directions, respectively, that are mutually perpendicular and are respectively perpendicular to the connecting direction of said partner terminal, between both ends of said terminal, (ii) a housing having a housing section and a base end section, said housing section having means for receiving said connector terminal, said housing further having;

a board mounting plate provided on the base end side of said housing;

in which the second bendable section of said connecting terminal is comprised of walls formed by bending both sides of a part of said second bendable section, notching a part in the longitudinal direction of the band-like plate held between the side walls, and curving said side walls on both sides of the notched section.

7. A connector comprising:

(i) a connector terminal having;

a connecting section formed on one end of the terminal for connecting the terminal with a partner terminal, a board insertion section formed on the other end of the terminal, a first and a second bendable section that are bendable in first and second directions, respectively, that are mutually perpendicular and are respectively perpendicular to the connecting direction of said partner terminal, between both ends of said terminal, (ii) a housing having a housing section and a base end section, said housing section having means for receiving said connector terminal, said housing further having;

a board mounting plate provided on the base end side of said housing;

in which said connector is formed by bending a strip-like structure in the form of the letter L and said first bendable section comprises the L-shaped bent section, in which the second bendable section of said connector terminal is constructed by forming a side wall by bending the edge of one side of said conducting plate, notching a part in the longitudinal direction of the band-like plate on the side where the side wall is formed, and by curving said side wall at the position where there is created the notched section.

8. A connector comprising:

(i) a connector terminal having;

a connecting section formed on one end of the terminal for connecting the terminal with a partner terminal, a board insertion section formed on the other end of the terminal, a first and a second bendable section that are bendable in first and second directions, respectively, that are mutually perpendicular and are respectively perpendicular to the connecting direction of a partner terminal, between both ends of said terminal, (ii) a housing having a housing section and a base end section, said housing section having means for receiving said connector terminal, said housing further having;

a board mounting plate provided on the base end side of said housing;

in which on the side of said one end of said connector terminal, where said connecting section is provided, there is formed a hooking hole for hooking said connecting section to the inside of the housing.

9. A connector terminal comprising;

(i) a connecting section formed on one end of said terminal for connecting the terminal with a partner terminal, (ii) a board insertion section formed on the other end of the terminal, (iii) a first and a second bendable section that are bendable in first and second directions, respectively, that are mutually perpendicular and are respectively perpendicular to the connecting direction of said partner terminal, between both ends of said terminal.

* * * * *